US005100116A

United States Patent [19]

Graushar

[11] Patent Number: 5,100,116

[45] Date of Patent: Mar. 31, 1992

[54] APPARATUS AND METHOD OF PROCESSING SIGNATURES

[75] Inventor: William T. Graushar, Wauwatosa, Wis.

[73] Assignee: Quad/Tech, Inc., Sussex, Wis.

[21] Appl. No.: 534,460

[22] Filed: Jun. 7, 1990

Related U.S. Application Data

[63] Continuation-in-part of Ser. No. 286,722, Dec. 19, 1988, abandoned.

[51] Int. Cl.[5] ..... B41F 13/54

[52] U.S. Cl. ..... 270/1.1; 270/54; 270/55; 270/57; 270/58; 271/244

[58] Field of Search ..... 270/1.1, 54, 55, 57, 270/58; 271/243, 244, 240

[56] References Cited

U.S. PATENT DOCUMENTS

| | | | |
|---|---|---|---|
| 2,251,943 | 8/1941 | Kleineberg | 270/54 |
| 2,804,189 | 8/1957 | Huck | 271/243 X |
| 3,260,516 | 7/1966 | Blair | 270/54 X |
| 3,902,715 | 9/1975 | Hubler et al. | 271/243 |
| 3,964,598 | 6/1976 | Alsop | 271/243 X |
| 3,971,481 | 7/1976 | Longenecker et al. | 271/243 X |
| 4,121,818 | 10/1978 | Riley et al. | 270/54 |
| 4,341,299 | 7/1982 | Walker et al. | 271/244 X |
| 4,395,031 | 7/1983 | Gruber et al. | 270/54 |
| 4,667,809 | 5/1987 | Raybuck | 271/240 X |
| 4,768,770 | 9/1988 | Pessina et al. | 271/243 X |
| 4,976,420 | 12/1990 | Flensberg et al. | 270/54 |

FOREIGN PATENT DOCUMENTS

| | | | |
|---|---|---|---|
| 3421208 | 12/1985 | Fed. Rep. of Germany | 270/58 |
| 1154053 | 4/1958 | France | 270/54 |
| 6515293 | 5/1966 | Netherlands | 270/58 |
| 2084966 | 4/1982 | United Kingdom | 270/58 |

*Primary Examiner*—Edward K. Look
*Assistant Examiner*—Todd Mattingly
*Attorney, Agent, or Firm*—Foley & Lardner

[57] ABSTRACT

A printing system for customizing folded signatures in a collating and binding line having a number of spaced signature feeders includes an auxiliary feeder for conveying signatures in a particular orientation to a primary feeder located in the line, and a printer positioned between the auxiliary and primary feeders for printing signatures before their delivery to the line such that the printing on the signatures lies substantially transverse to the folds of the signatures. The system further includes an arrangement for aligning the signatures in a particular orientation between the auxiliary feeder and primary feeder.

19 Claims, 6 Drawing Sheets

APPARATUS AND METHOD OF PROCESSING SIGNATURES

CROSS REFERENCE TO RELATED APPLICATION

This is a continuation-in-part of copending application U.S. Ser. No. 07/286,722 filed Dec. 19, 1988.

TECHNICAL FIELD

The present invention relates generally to an apparatus and method of processing signatures in booklet or magazine form and, more particularly, to an apparatus and method of providing personalized information in a variety of locations upon the signatures as they are collated and bound.

BACKGROUND OF THE INVENTION

Collating and binding systems for saddle stitchers are, of course, well known in the printing industry for mass producing booklets, magazines, catalogues, advertising brochures and the like. Typically, one or more sharply folded and generally pre-printed blanks or signatures are sequentially fed by a number of spaced signature feeders. The signatures are delivered such that the folded margins or spines of the signatures come to rest upon a collating conveyor line or chain which travels past the signature feeders. The conveyor gathers the signatures, one on top of the other, and moves them through one or more on-line printing stations to a stitching or binding station. The assembled signatures then are usually diverted to a trimming station and further led to a labelling station where mailing labels which are pre-printed or printed on-line are affixed.

Prior art systems of this type contemplate the computer controlled production of various editions of books or catalogues of internal and external signatures containing individually tailored information or customized printing on selected signatures without expensive alterations. This flexibility remains important in satisfying the demands of a particular market or geographical destination. For instance, it may be desirable to offer certain customers or subscribers various features or selected advertising depending upon their locale, income or occupation. Likewise, it may be relevant to customize products or services contingent upon a customer's previous buying history. In addition, flexibility of printing external or cover signatures is important to the sender in meeting postal regulations and qualifying for substantial postage discounts.

One system which discloses the customized printing of signatures is shown in U.S. Pat. No. 4,121,818 issued on Oct. 24, 1978, to Reilly et al. In this arrangement, a first printer adjacent the collating conveyor is located on line between the signature feeders while a second printer is located at the end of the conveyor for printing mailing labels on the gathered books. This system is limiting in the sense that only the outside pages of internal signatures of a book may be printed as they travel upon the conveyor. In addition, the Reilly et al system is particularly inflexible in applying printing only in a direction parallel to the spine or fold of the internal signature. This results in the customized information running opposite to the normal left to right reading of the book and forces the reader to turn the book or reader's head in order to digest the tailored message.

A similar drawback is present in another such system, disclosed in U.S. Pat. No. 4,395,031 issued on July 26, 1983, to Gruber et al. According to this system, a printer cooperates with a plate-like member to open an internal signature selected from the collating conveyor and provide printing on both the inside and outside of a signature. As in other bindery systems, the personalization of internal signatures occurs adjacent the conveyor only downstream of all the signature feeders just before the signatures are bound. This creates the same problematic result in printing disposition as discussed above.

To aid in fully appreciating the problem which develops from the on-line customized printing of internal signatures, a discussion of further details of a collating and binding system which is thoroughly conventional in the printing industry is provided. Such systems must be capable of efficiently producing, in high volume and at high speeds, books of various numbers of pages formed of paper stock of different sizes, weights and finishes. The paper stock is stored in a supply stack in each of the signature feeders which are aligned in rows of multi-unit sections, also known in the art as boxes or pockets. Each of these signature feeders extracts a single folded signature from their supply stack, opens the signature and delivers it, with its fold in draped fashion upon a collating conveyor chain which travels directly in front of the aligned signature feeders. Such feeders are well known and are disclosed in U.S. Pat. Nos. 2,251,943 issued Aug. 12, 1941 to Kleineberg.

Because of the nature in which signatures are handled and gathered, the prior art has generally been known to provide customized printing of internal signatures by placing printing devices adjacent the collating conveyor chain such that printing is applied in a direction paralleling the chain and the fold of the signature. In short, this approach has not provided an easily readable or flexible personalization in existing printing systems dealing with the collation of internal signatures.

One system which provides customized printing in a direction transverse to the spine or fold of the signature is described in German Patent No. 3,421,208 issued Dec. 12, 1985 to Wenzke. In this device, a conveyor belt transports a signature under an addressing device for customized printing before the signature is delivered to the collating and binding line. The problem with this design, however, is that there is no control over the position or registration of the signature on the conveyor belt. This, in turn, may cause crooked and/or inaccurate personalization as well as possible jamming as the customized but unregistered signature is delivered to the collating and binding line. The probability of these problems escalates with the increasingly higher operating speeds of these systems.

From the foregoing, it can be seen that various attempts have been made by the prior art to upgrade the customized printing capability of collating and binding systems. However, there remains a need in this well-developed art for a system which offers more flexibility and control in the provision of personalized information and overall processing of signatures.

SUMMARY OF THE INVENTION

The present invention advantageously provides an improved customizing capability for the high speed collating and binding of books of signatures. The improved customizing system provides noteworthy versatility, and is readily adaptable into existing systems with a minimum of modification.

These and other advantages are realized, in one aspect of the invention, by a signature collating and binding system having a plurality of signature feeders spaced along a collation and binding line to which the signatures are serially fed. An auxiliary feeder delivers signatures into a signature feeder and cooperates with a customizing mechanism located between the auxiliary feeder and the signature feeder for customizing signatures before their delivery to the signature feeder and the collation and binding line. The auxiliary feeder preferably includes a conveyor for transporting signatures from the auxiliary feeder to the signature feeder. A registration arrangement maintains the alignment of the signatures between the auxiliary feeder and the signature feeder.

The present invention also relates to a method of customizing signatures in a signature collating and binding system having a plurality of signature feeders spaced along a collation and binding line to which the signatures are serially fed. The method includes the steps of delivering signatures into a signature feeder and customizing the signatures before their delivery to the signature feeder and collation and binding line. The method further includes the steps of conveying the signatures from a supply hopper towards the signature feeder so that the spine or fold of the signatures is leading towards the signature feeder and aligning signatures so that the spine remains in a predetermined orientation relative to the collation and binding line between the auxiliary feeder and the signature feeder.

In a highly preferred embodiment, the customizing system includes a printing arrangement and contemplates delivery belts cooperating with the auxiliary feeder for delivering signatures at a first speed such that the leading edges are driven against a moving register stop wall on the conveyor. Pinch belts moving at a second, slower speed cooperate with the conveyor for transporting the signatures to the printing arrangement and signature feeder such that the leading edges remain generally parallel to the collation and binding line to ensure printing and delivery substantially transverse to the leading edges of the signatures.

BRIEF DESCRIPTION OF THE DRAWING

The invention will become better understood by reference to the following detailed description of the preferred exemplary embodiment when read in conjunction with the appended drawing wherein like numerals denote like elements and.

DETAILED DESCRIPTION OF THE PREFERRED EMBODIMENT

Figure 1:
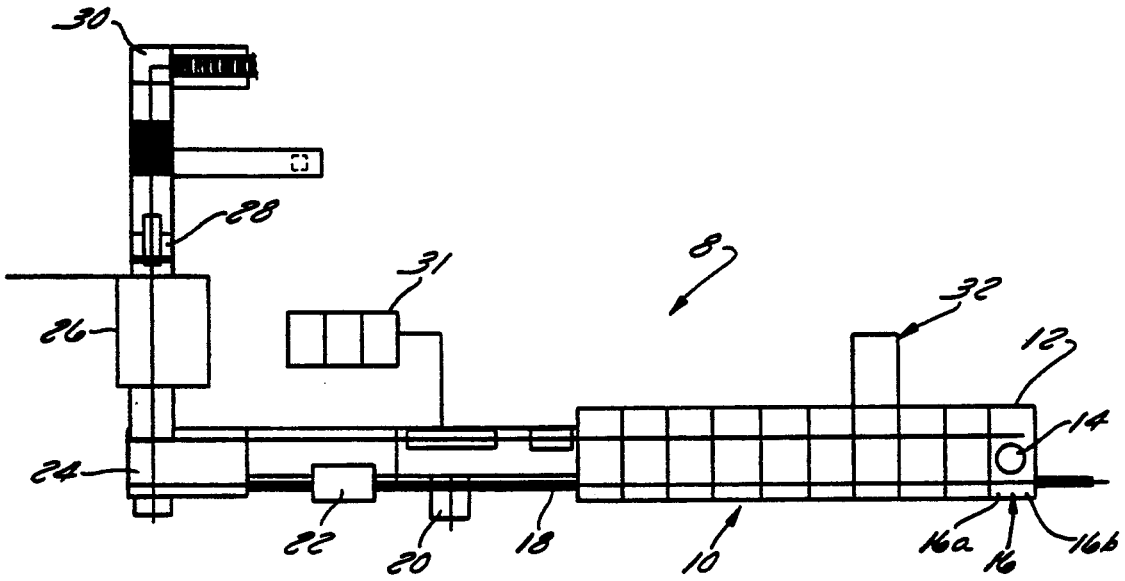
FIG. 1 is a schematic block diagram of a collating and binding system employing the present invention.

Referring to FIG. 1, a collation and binding system 8 for a saddle stitcher encompassed by the present invention is employed to produce various catalogues, brochures, periodicals, etc. containing different collections of signatures for different customers or subscribers. System 8 suitably comprises an inserter 10 having a plurality of pockets, (boxes) 12, a collating chain (conveyor) 18, a caliper 20, one or more printing units (stations) 22, a stitcher 24, a trimmer 26, a labeling station 28, and a stacker 30.

Each pocket 12 holds a supply of signatures 16. Signatures 16 are usually preprinted and folded such that one sheet, a lap sheet 16*a*, is wider than the other (short sheet) 16*b*. Each pocket 12 is equipped with a signature feeder 14 operative to selectively deliver a singular signature 16 from a supply stack within the pocket.

Collating chain or conveyor 18 collects signatures 16 from the signature feeders 14 and transports the signatures along a collation and binding line. As the signatures 16 are gathered, they move past caliper 20, which monitors the appropriate thickness of the book (signature collection) and then travel through one or more printing stations 22 where customized "on the fly" printing can be applied. After the printing, the conveyor 18 pushes the signatures to stitcher 24 where they are bound, to create an assembled book such as by stapling or the like.

The assembled book is then diverted onto another conveyor to trimmer 26 where its edges are trimmed and labeling station 28 where a mailing label is applied. Thereafter, the assembled books may be conveyed to stacker 30 and readied for mail or other distribution.

The collating and binding system generally described above is conventionally controlled by a conventional computer or programmable controller 31, the details of which are omitted as they do not form the essence of the invention. Likewise, the inserter 10, feeder 14, caliper 20, printer 22, stitcher 24, trimmer 26, labeling station 28, and stacker 30 are of conventional construction and do not require a detailed discussion except with respect to certain modifications as will be hereafter explained.

Figure 2:
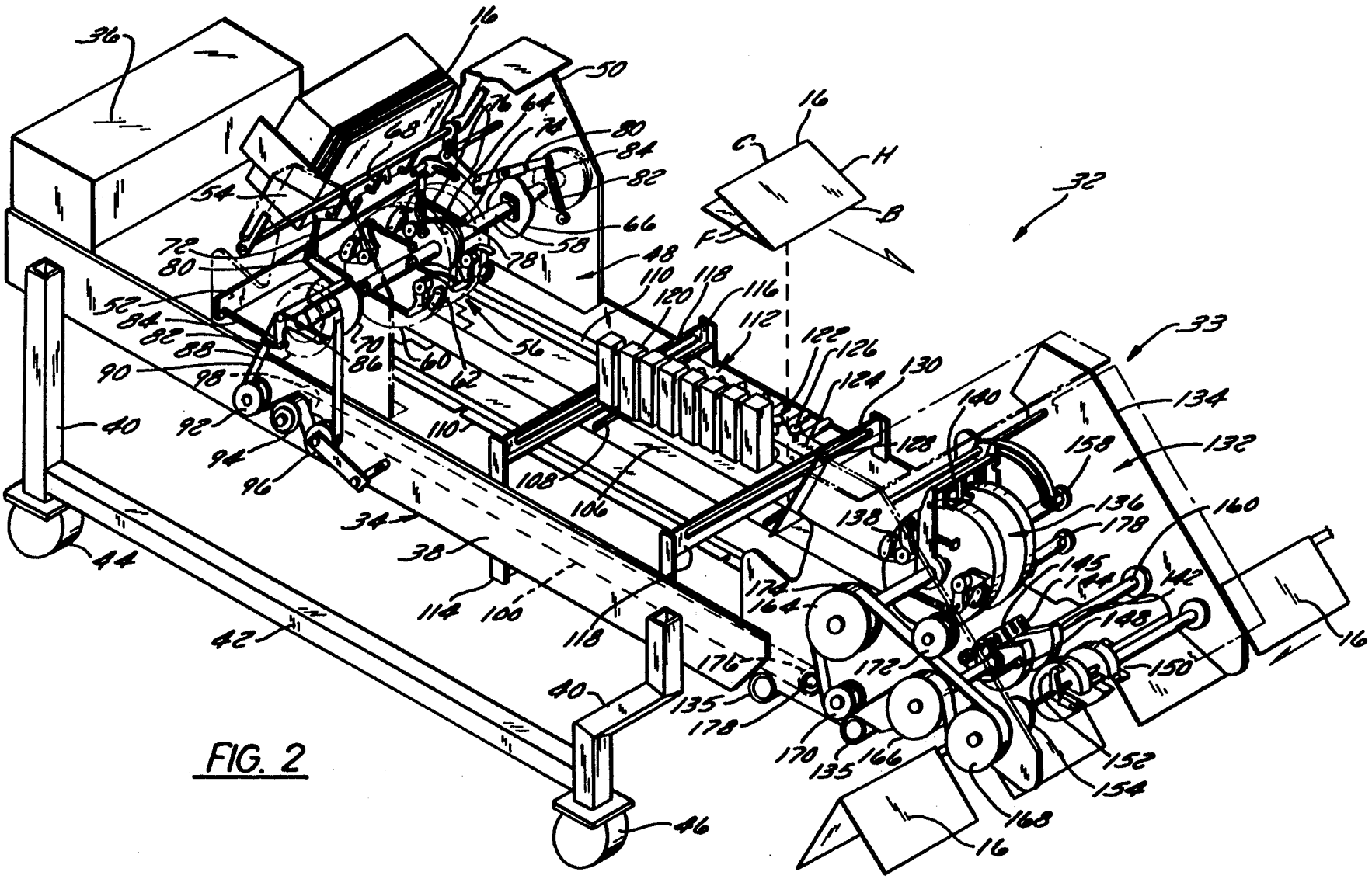
FIG. 2 is a fragmentary, perspective view of the printing system, signature feeders and collation and binding line shown in FIG. 1 with various elements broken away for clarity.
Figure 3:
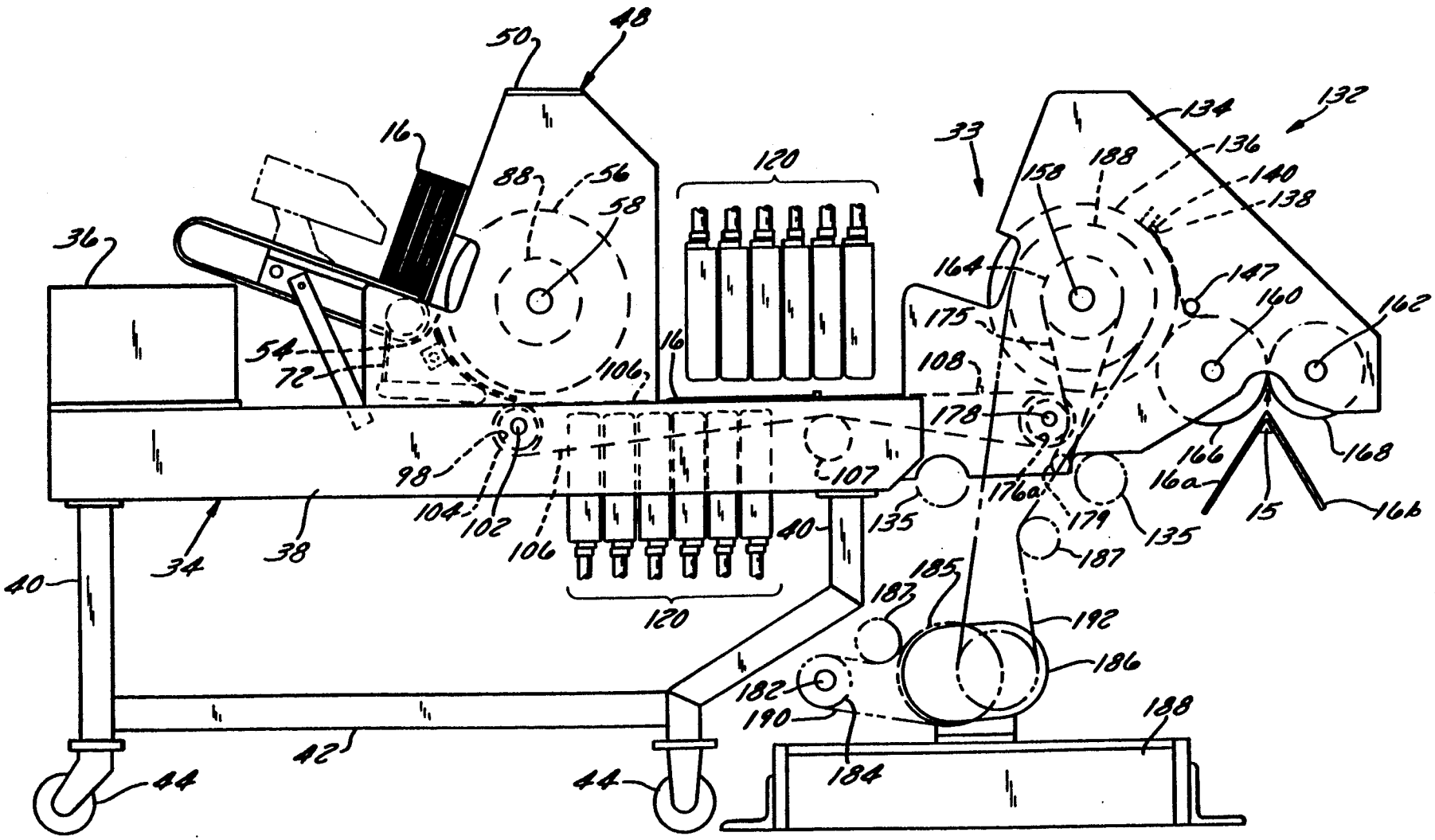
FIG. 3 is an enlarged, fragmentary side view of the printing system and signature feeder shown in FIG. 1.

Turning now to FIGS. 2 and 3, a printing 15 system 32 in accordance with the present invention includes a front end 33 which is adapted to deliver signatures to the collating and binding line in the same fashion as the signature feeders 14. Printing system 32 may be used to replace one or more signature feeders 14, which are easily removed from the line, where it is desired to provide customized printing of signatures 16 in the pocket 12. Alternatively, the printing system 32 may be added to a line of existing signature feeders 14 at whatever point desired in inserter 10.

More particularly, printing system 32 includes a portable print table 34 having a rear jogging surface 36 connected between side rails 38. Print table 34 has a pair of front and rear legs 40 interconnected on each side by a brace 42 running parallel to side rail 38. Each of legs 40 is provided with a swivel caster 44 as well as 20 a brake and a height adjusting mechanism if desired, so that table 34 may be easily transported and set into a working registration position relative to the collating and binding line.

A suitable feeder 48 (sometimes hereinafter referred to as auxiliary feeder 48) is disposed on print table 34.

Because the structure and function of feeder 48 are well known to those skilled in the art, only the major portions merit description. Auxiliary feeder 48 comprises a pair of upstanding side frames 50 joined by a brace 52 and mounted on table 34 for supporting various components of feeder. In particular, a supply hopper 54 is carried between the side frames 50 for holding a stack of signatures 16 generally upright with their folded backs or spines at the bottom of hopper, their lap sheets 16*a* facing forwardly and their short sheets 16*b* directed rearwardly. The signatures 16 are jogged or aligned manually by an operator using jogging surface 36 before they are placed in hopper 54. A pickup drum 56 is mounted for continuous rotation on a drive shaft 58 supported between the frames and is composed of spaced discs 60 bearing grippers 62. Instead of furnishing a single gripper for each disc 60, a pair of grippers is oppositely located on each disc to enable feeder 48 to be run at half speed and still provide the desired feed results. Also mounted for rotation on drive shaft 58 are gripper cams 64 for controlling the opening and closing 10 of the grippers 62, a sucker cam 66 for regulating a sucker bar 68 positioned in front of the hopper 54 and a feed cam 70 for governing a feed mechanism 72 that properly indexes signatures 16 in hopper 54. Each of grippers 62 has a connecting rod 74 surrounded by a spring 76 which constantly urges a follower 78 at the end of the rod 74 against gripper cam 64, only one of which is shown in FIG. 2. Similarly, sucker bar 68 and feed mechanism 72, include linkages 80 having rods 82 journalled to frame 50 and brace 52, respectively, and springs 84 to maintain rollers 86 on their linkages in riding contact with the sucker cam 66 and feed cam 70 respectively.

The end of the drive shaft 58 carries a sprocket 88 driven by a belt 90. Belt 90 is entrained about sprocket 88 and three lower idler sprockets 92, 94, and 96. The middle idler sprocket 94 is fixed alongside a sprocket 98 which is driven by a belt 100 (FIG. 2) connected to the drive mechanism for the system 8 to be described later. Sprocket 98 is connected by a shaft 102 to an idler 104 (FIG. 3) which carries a conveyor belt 106 running longitudinally of table 34 below drum 56. Conveyor belt 106 has a plurality of spaced pusher lugs 108 and travels between a pair of signature guides 110 disposed on the table 34 parallel the conveyor path. As seen in FIG. 3, the lower run of conveyor belt 106 may be tensioned by, for example, using an idler 107 mounted between the side rails 38. By this arrangement of auxiliary feeder 48, counterclockwise rotation of drive shaft 58 will cause feeding mechanism 72 to push signatures 16 forward in hopper 54, sucker bar 68 to selectively extract the forwardmost signature, and grippers 62 to close to transfer the signature from the hopper through 900 counterclockwise rotation of pickup drum 56. At this point, the cam 64 effects opening of grippers 62 to release signature 16 in flattened position upon forwardly moving conveyor belt 106 Thus, the folded back (spine) B of signature 16 (shown raised from belt 106 in FIG. 2 for clarity), becomes the leading edge, the head H and foot F are properly aligned by and against guides 110 and the cut face C (trailing edge) is registered against a pushing lug 108 on the belt 106.

A distinctive feature of the invention resides in the location and application of a printing mechanism 112 used to print customized information on the signatures 16 selectively fed from the auxiliary feeder 48. Straddled across the width and spaced from the top and/or bottom of the print table 34 is a mounting framework 114 having corner plates 116 attached to side rails 30 and transverse braces 118 joined to corner plates 116. Printing mechanism 112 preferably comprises a bank of conventional ink jet heads 120 which are adjustably secured to the top and/or bottom of the mounting framework 114. The ink jet heads 120 are ultimately controlled by system computer 31, and in accordance with conventional techniques, generally function to print one or two lines per head. Each head 120 is fixed to a shaft 122 which passes through a mounting block 124 having a locking knob 126 to lock the head in place. Common to each mounting block 124 is a locking fastener 128 which rides in a slot 130 formed in each of the braces 118.

It should be appreciated that this structure enables a course adjustment of the bank of heads 120 by sliding and locking the fastener 128 in place. A fine or limited adjustment of an individual head 120 may thereafter be made by using the locking knobs 126 so that the heads may be positioned as desired relative to the width of printing table 34. More specifically, this structure advantageously provides that a signature 16 selectively routed and particularly oriented upon conveyor belt 106 can be produced with a personalized or tailored message printed almost anywhere on the exposed surfaces of signature 16 with the printed message lying 10 substantially transverse to the leading edge (folded backbone) B of the signature. Otherwise stated, the printing lies generally parallel to the head H or foot F of signature 16. This results in customized printing being presented within a book so that it can be easily read without having to turn the book or the reader's head.

Printing mechanism 112 operates in its preferred embodiment adjunct to a primary feeder 132 which serves to deliver a printed signature 16 to the collating and binding line. Referring to FIG. 2, primary feeder 132 includes a pair of upstanding side frames 134, the bottoms of which are cut out to rest upon a pair of support tubes 135 which align the signature feeders 14 in inserter 10. Being similar in some respects to the auxiliary feeder 48, primary feeder 132 includes a pickup drum 136 having cam-controlled grippers 138 as previously described for handling the signatures 16. Primary feeder 132 is also similar to conventional signature feeders and includes a register stop 140 which is adjustable relative to the circumference of the drum 136 depending upon the size of the signature. Adjacent pickup drum 136 is a transfer drum 142 having a set of primary grippers 144 and a set of secondary, or lap grippers, 146, the opening and closing of which are regulated by a follower 148 which rides against a suitable cam (not shown). An opener drum 150, including a gripper 152 which is pivotably swung open and closed by cam 154 is also provided. Each of the pickup, transfer and opener drums 136, 142, 150 are mounted on shafts 158, 160 and 162 respectively, rotatably mounted between the frames 134.

In order to drive primary feeder 132, the ends of the shafts 158, 160, and 162 carry drive sprockets 164, 166, 168 respectively Sprockets 164, 166 and 168 cooperate with a pair of idlers 170, 172 outside of side frames 134 to form a path for a drive belt 174 entrained about the drive sprockets and idlers. Sprockets 176 and 176*a* are mounted inside the side frame 134 on the end of a shaft 178 extending between side frames 134. The belt 100 extending from the sprocket 98 in the auxiliary feeder 48 is wound around the outermost sprocket 176. A sprocket 177 is mounted inside the side frame 134 on drive shaft 158 and together with sprocket 176a and an idler shaft 179 extending between the side frames 134 provides a path for a drive belt 175. The shaft 178 also carries a sprocket 180 around which the conveyor belt 106 is wound so that clockwise rotation of the sprockets 176, 176a and shaft 178 induced by the drive belt 175 will cause the conveyor belt 106 to move in a direction toward the primary feeder 132.

Printing system 32 is driven in synchronism with inserter 10, suitably by the drive mechanism associated with inserter 10. Referring to FIG. 3, the drive means for inserter 10 typically includes a drive shaft 182 which extends through all the signature feeders 14 of inserter 10 and carries a sprocket 184. A gear reducer 186 is mounted on a base 188 from the floor and is driven from sprocket 184 by a chain 190. A driving force is conveyed by a chain 192 from the gear reducer 186 to a sprocket 188 mounted inside side frame 134 on drive shaft 158 of pickup drum 136. Suitable mechanism 187 may be used to provide proper belt tension. Thus, counterclockwise rotation of the drive shaft 158 will move the pickup drum 136 counterclockwise, the transfer drum 142 clockwise and the opener drum 150 counterclockwise.

Once a signature 16 has been custom printed, it continues being transported to the forward end of the conveyor belt 106. At this point, signature 16 is handled by primary feeder 132 in a manner similar to a conventional signature feeder 14 as is well known in the art. The operation of a signature feeder is described in U.S. Pat. No. 2,251,943 as previously referred to. In summary, the pickup drum 136 rotates counterclockwise 90° from the position shown in FIG. 2 so that cam controlled grippers 138 will close upon the folded backbone B of signature 16. Pickup drum 136 continues to rotate to carry signature 16 around the drum and bring the backbone B against the register stop 140. In this position, pickup drum grippers 138 open, transfer drum primary grippers 144 close across both the lap sheet 16a and short sheet 16b and transfer drum secondary (lap) grippers 146 close against only the lap sheet 16a. Clockwise rotation of the transfer drum 142 strips the signature 16 from the pickup drum 136 and brings the gripped signature sheets 16a, 16b under an idler shaft 147 fixed between side frames 134 toward the opener drum 150. Drum 150 is rotating counterclockwise. At the proper position, the short sheet 16b is released (popped) by primary grippers 144 while the lap sheet 16a remains held by lap grippers 146, whereupon the open drum gripper 152 grabs short sheet 16b so that continuing rotation of the drums 142, 150 spreads the customized signature 16 to drop it in straddled fashion upon the conveyor chain 18.

The signatures 16 are then conventionally gathered and selected signatures may be conventionally printed at station 22 (FIG. 1), if desired, with additional information on line before the books are stitched or stapled together. However, it should be understood that because of the orientation, inter alia, of the signatures 16, the on-line printing by stations 22 runs parallel to the spine or backbone B of the signature as contrasted with the customized printing in the pocket 12 provided by the present invention. After the books have been assembled, they are conventionally diverted with the backbone B leading so that after trimming the lap, mailing labels may be affixed in any fashion desired so that the label may run parallel or transverse to the spine.

It should be appreciated, the present invention greatly enhances the flexibility of printing customized signatures in a collating and binding system. Such flexibility is attained without losses in operating speeds or creating additional problems in handling of signatures 16. The preferred form of the invention is easily adaptable to existing systems as either a replacement or additional unit in the inserter 10 and offers a versatility for efficient handling of signature stocks of various sizes, weights and finishes.

Unlike prior art devices, the present invention provides for printing signatures 16 in the pocket 12 before they are delivered to the collating and binding line. In addition, personalization of signatures is expanded to a greater possible surface area on the pages of a selected signature with a resultant tailored message being more intelligible to the reader because it is presented in a manner consistent with the normal reading of the book. By focusing upon a modification of the conventional basic signature feeder 14, rather than the prior art's modification of the in line portion of the system, the printing system of the present invention provides an advance which markedly improves customized signature printing capability.

While the invention now has been described with reference to a preferred embodiment, those skilled in the art will appreciate that certain substitutions, alterations and omissions may be made without departing from the spirit thereof. For example, it should be understood that unfolded signatures could be fed with a leading edge from the auxiliary feeder 48, customized with the printing means 112 and then folded and fed by the primary feeder 132 to the collation and binding line. It should also be appreciated that while the foregoing describes utilizing lap signatures, the present invention is equally adaptable to handling of non-lap signatures by modifying certain of the gripper structures with suction 10 devices as is well known in the art. Further, the invention may be utilized in a collating system where signatures are stacked on top of each other using a flattened conveyor belt.

Referring now to FIGS. 4–7, an alternative embodiment of the invention in which signatures are more positively registered (aligned) before being delivered to the collating and binding line will be described. Primed numbers are used in these figures to indicate elements of the alternative embodiment which generally correspond to previously numbered elements appearing in FIGS. 1–3. It should be understood that in some situations, especially at higher speeds and with lighter signature stock, pushing on the cut faces (trailing edges) C of lap signatures as they are being transported on conveyor belt 106 may cause deformation and/or misdirection of the signatures. This, in turn, can impair the angle of customized printing and proper delivery of the signatures to the primary feeder. In an effort to minimize crooked or skewed printing and jamming of the signatures as they are subsequently conveyed and fed to the collating and binding line, the invention contemplates a registration arrangement for maintaining the leading edges of signatures substantially parallel to the collating and binding line between auxiliary feeder 48' and primary feeder 132'.

Figure 4:
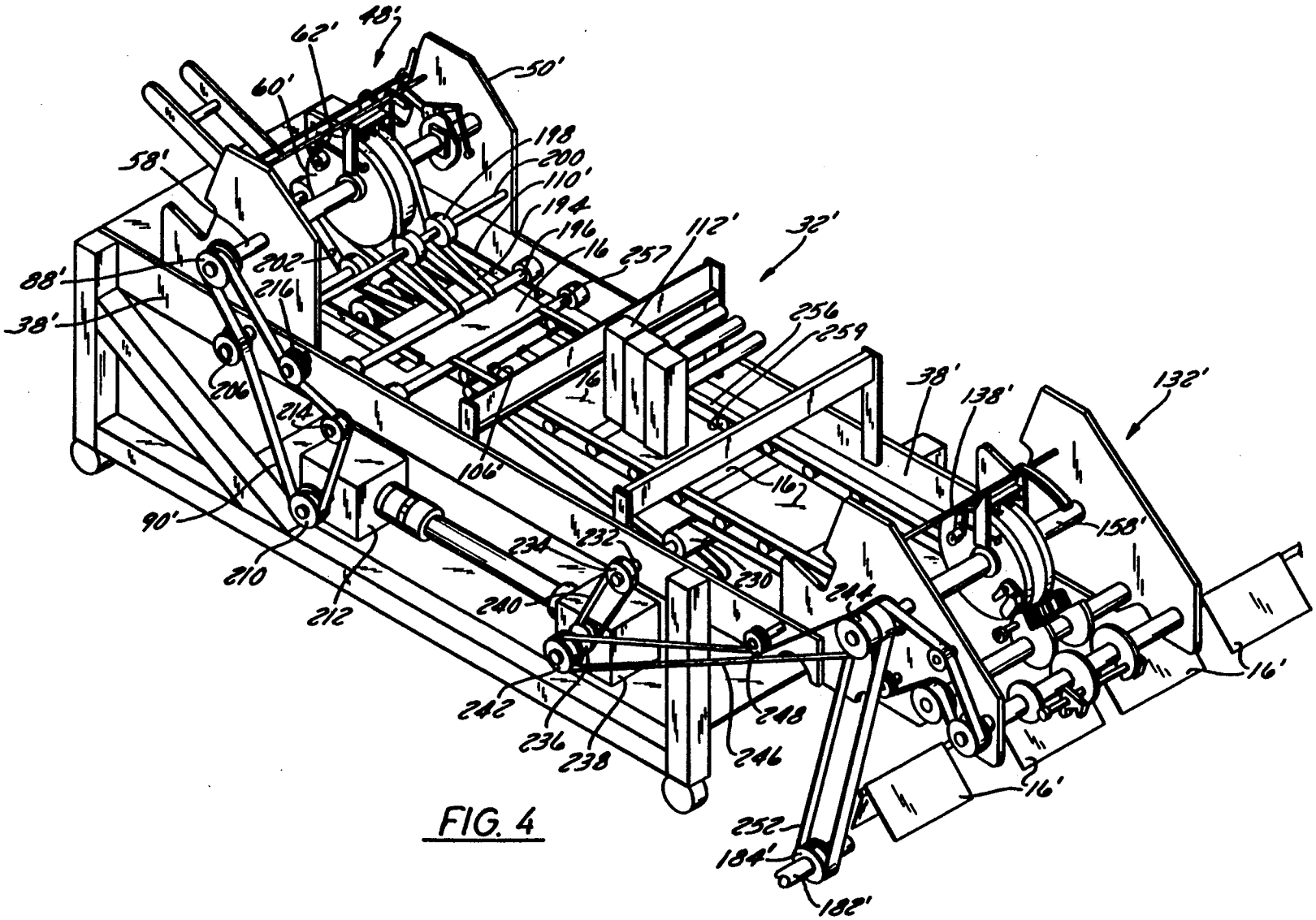
FIG. 4 is a fragmentary, perspective view of an alternative embodiment of the invention.
Figure 6:
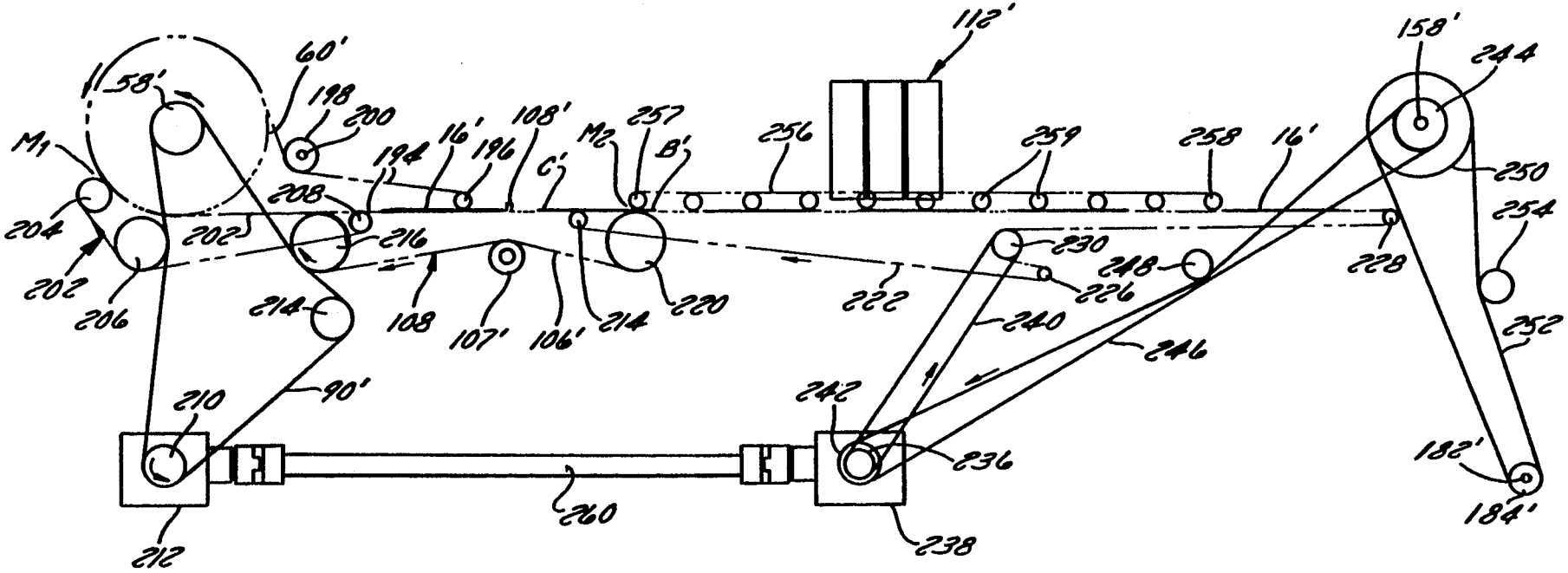
FIG. 6 is a diagrammatic side view of the moving belts used in the system of FIG. 4.
Figure 5:
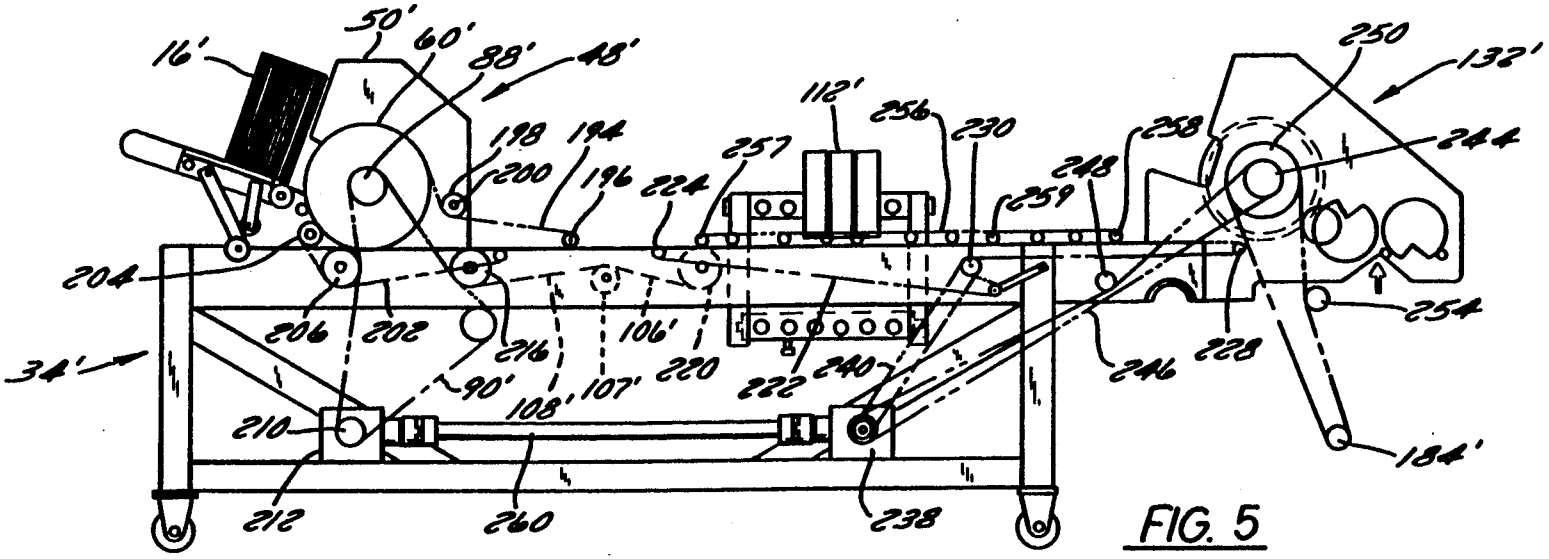
FIG. 5 is a fragmentary side view of the system shown in FIG. 4.

In accordance with the invention, the printing (customizing) system 32' includes a pair of parallel upper delivery belts 194 entrained around pickup drum discs 60' and an idler shaft 196. Delivery belts 194 may be suitably tensioned by employing adjustable idlers 198 mounted on a shaft 200 between side frames 50'. As best seen in FIGS. 5 and 6, a pair of lower delivery belts 202 are wrapped around sprockets 204 and 206 with an idler shaft 208. The lower runs of upper delivery belts 194 are disposed in close sandwiching relationship with the upper runs of lower delivery belts 202 and form a nipping mouth $M_1$ (FIG. 6) for receiving a signature from grippers 62' located outside the upper delivery belts 194. The end of drive shaft 58' carries a sprocket 88' driven by belt 90'. Belt 90' is entrained about sprocket 88', a drive sprocket 210 on a gear box 212, and an idler sprocket 214. Belt 90' is also in contiguous driving relationship with lower delivery belt sprocket 206 and a driven sprocket 216 which transfers rotation to a trio of colinear sprockets 218 (FIG. 7) mounted between side rails 38'. By setting the ratio of gear box 212 and properly selecting the size and disposition of the appropriate sprockets, belt 90' is driven at a first speed $S_1$, which is translated to delivery belts 194, 202. Likewise, sprocket 216 is sized to rotate at a second speed $S_2$ slower than $S_1$, as will be explained. Each of sprockets 218 carries a conveyor belt 106' which is wound around a complementary idler sprocket 220 and is driven at slower speed $S_2$ due to its connection with rotating sprocket 216. As best seen in FIGS. 5 and 6, conveyor belts 106' are each provided with a plurality of lugs 108' and travel for a distance between signature guides 110' (FIG. 4) disposed on table 34'. The lower runs of conveyor belts 106' may be tensioned by idlers 107' mounted between side rails 38'.

Figure 7:
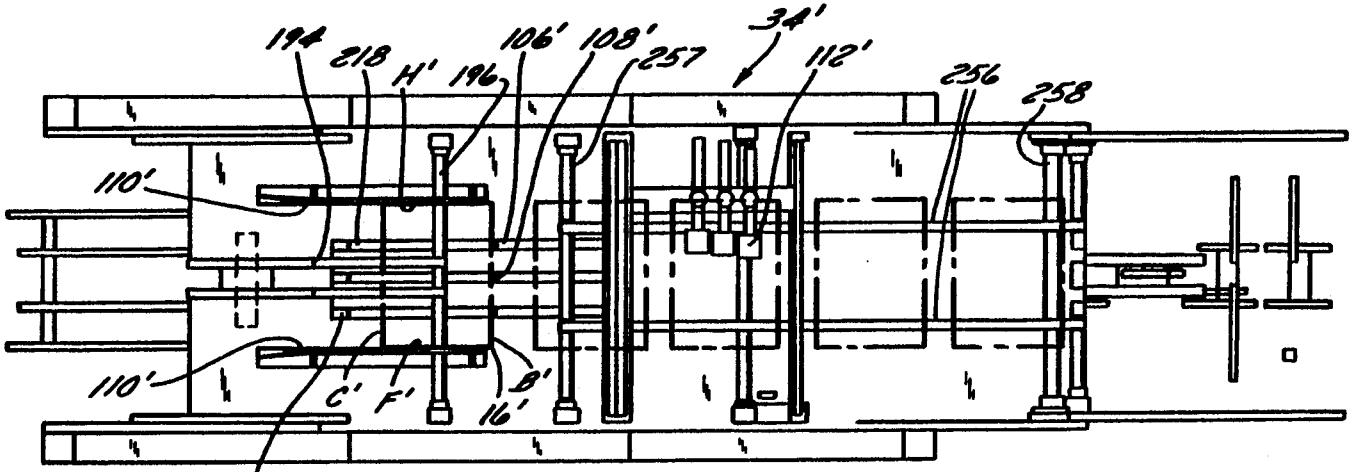
FIG. 7 is a top view of the system shown in FIG. 5.

With this arrangement, counterclockwise rotation of drive shaft 58' will cause grippers 62' to deliver the leading edges B' (FIG. 7) of signatures 16' in spaced relationship into nipping mouth $M_1$ (FIG. 6). The signatures are positively gripped along their upper and lower surfaces and across the width between delivery belts 194, 202. Referring briefly to FIGS. 6 and 7, belts 194, 202 function as a positive transport device to advance the head H' and foot F' of signatures 16' along signature guides 110' at first speed $S_1$ such that the unlapped leading edges B' of signatures 16' are accelerated against lugs 108' moving at slower speed $S_2$ on the cooperating, underlying conveyor belts 106'. Lugs 108' form a horizontally moving register stop wall which is substantially parallel to the collating and binding line. As can be seen in FIG. 6, each upper delivery belt 194 extends beyond idler 208 and provides a short run which directly passes over conveyor belts 106'. Upper delivery belts 194 thus can be considered as the primary transport device to drive signatures 16' over the slower moving conveyor belts 106' and against lugs 108'.

Signatures 16', once positively aligned against lugs 108' and signature guides 110', are transported at the slower speed $S_2$ by conveyor belts 106' for proper customizing. As the trailing edge of each signature 16' passes idler shaft 196, conveyor belts 106' support each signature from its lower surface and convey each signature onto a pair of parallel lower pinch belts 222. Belts 222 are entrained about spaced idler shafts 224, 226, 228 as well as sprocket 230. As shown in FIG. 4, sprocket 230 is mounted on a shaft 232, the outer end of which carries pulley 234. Pulley 234, together with a sprocket 236 on gear box 238, provides a path for a drive belt 240. Outwardly of sprocket 236 is a pulley 242 which cooperates with a pulley 244 on drive shaft 158' of primary feeder 132'. A drive belt 246 is wound around pulleys 242, 244 and is suitably tensioned by an adjustable idler 248. Also mounted on drive shaft 158' behind pulley 244 is a sprocket 250 which is driven by means of a drive belt 252 cooperating with sprocket 184' on drive shaft 182'. A suitable mechanism 254 may again be used to provide proper belt tension.

A hold down device for the upper surfaces of signatures 16' is suitably provided. Specifically, a pair of parallel upper pinch belts 256 are entrained about spaced idler shafts 257, 258 (FIG. 7) and idler rollers 259. The lower runs of upper pinch belts 256 are superimposed in sandwiching relationship with the upper runs of lower pinch belts 222. Disposed above and between the upper pinch belts is adjustable printing mechanism 112' as aforedescribed.

It should be understood that a driving force from drive shaft 182' is transferred via belts 252, 246 to gear box 238, a rotating shaft 260, gear box 212 and finally to belt 90' to deliver signatures 16' in spaced registry upon conveyor belts 106'. Likewise, a driving force is translated from drive shaft 182' through belt 240 which will subsequently cause signatures 16' to advance along lower pinch belts 222 at speed $S_2$ so that their leading edges B' move into a nip $M_2$ (FIG. 6). From this point, pinch belts 222, 256 again function as a transport device to engage the signatures on their upper and lower surfaces and maintain the alignment of signatures along the head, foot and spine as they are customized at printing mechanism 112'. Once each signature has been personalized, it continues being transported and aligned to the forward end of lower pinch belt 222. At this point, grippers 138' on primary feeder 132' pick up the registered signature and proceed as before described to deliver signature to collating and binding line.

In the embodiment just described, a typical speed $S_1$ for delivery belts 194, 202 may be in the order of 400 feet per minute while speed $S_2$ may run somewhat slower at about 250 feet per minute in order to ensure quality customization. While the alternative embodiment discloses a printer as the customizing mechanism, it is sometimes preferable to employ a dot wacker which strategically places labels, seals or the like upon targeted areas of signatures. In similar fashion, a skilled artisan may employ a tipping device for affixing onserts or the like in a desired area of signature 16'. In order to allow for signatures of different weights and thicknesses, the invention contemplates various adjustments such as, for example, at nips $M_1$, $M_2$ and idler shaft 196. While the foregoing embodiment employs sandwiching delivery belts 194, 202, pinch belts 222, 256 and flat conveyor belts 106' for transporting and maintaining alignment of signatures, other suitable conveyance devices such as suction belts may be used. Accordingly, the foregoing description is meant to be exemplary only and should not be deemed limitative on the scope of the invention set forth in the following claims.

I claim:

1. In a customizing system for a signature collating and binding line having primary feeding means for delivering individual signatures to said collating and binding line, auxiliary feeding means for supplying said signatures in spaced apart relationship to said primary feeding means, and customizing means, disposed between said primary feeding means and said auxiliary feeding means for customizing said signatures before the delivery of said signatures to said collating and binding line, each of said signatures having a head portion, a foot portion, a trailing edge, a leading edge oriented towards said collating and binding line, an upper surface and a lower surface, the improvement comprising:

registration means, engageable with said head portion and said foot portion of said signatures and at least one of said trailing or leading edges along at least one of said upper or lower surfaces, for maintaining said signatures in spaced apart relationship and aligning said signatures continuously and individually before their delivery to said collating and binding line such that each said leading edge remains substantially parallel to said collating and binding line between auxiliary feeding means and said primary feeding means.

2. A customizing system for a signature collating and binding line having a plurality of signature feeders spaced along the collating and binding line for serially feeding individual signatures thereto, each of said signatures being preprinted and having a head portion, a foot portion, a trailing edge, a leading edge, an upper surface and a lower surface, the system being of the type including:

primary feeding means for delivering signatures to the collating and binding line;

auxiliary feeding means for supplying signatures in a flattened, spaced apart position with their leading edges oriented toward the collating and binding line and fed to said primary feeding means;

conveying means, disposed generally transverse to said collating and binding line, for carrying signatures between said auxiliary feeding means and said primary feeding means;

customizing means, associated with said conveying means between said primary feeding means and said auxiliary feeding means, for providing said signatures with customized information before their delivery to the collating and binding line; and control means for regulating said customizing means, the improvement comprising:

stationary and movable registration means for aligning said signatures continuously and individually between said auxiliary feeding means and said primary feeding means before the delivery of said signatures to said collating and binding line;

said registration means being engageable with said signatures along said head portion and said foot portion and one of said trailing or leading edges such that each of said leading edges remains substantially parallel to said collating and binding line.

3. The customizing system of claim 2, wherein said primary feeding means, said auxiliary feeding means, said conveying means and said customizing means are collectively mounted on a portable table adapted for selective interconnection with said collating and binding line.

4. The customizing system of claim 3, wherein said registration means includes stationary signature guide means mounted on said table and engageable with said head portion and said foot portion of said signatures.

5. The customizing system of claim 2, wherein said registration means includes movable lugs on said conveying means engageable with one of said leading or trailing edges.

6. The customizing system of claim 5, wherein said registration means includes first transport means, cooperable with said conveying means and engageable with said head portion and said foot portion on said upper surface and lower surface of said signatures, for transporting said signatures to said customizing means and said primary feeding means.

7. The customizing system of claim 6, wherein said auxiliary feeding means includes second transport means, engageable with said upper surface and said lower surface of said signatures, for delivering said signatures at a first speed such that said leading edges of said signatures register against said movable lugs on said conveying means.

8. The customizing system of claim 7, wherein said conveying means and said first transport means are operable at a second speed slower than said first speed

9. The customizing system of claim 6, wherein said first transport means comprises upper pinch belts means and lower pinch belts, said upper pinch belts and said lower pinch belts cooperating to receive said signatures from said conveying means in sandwiching relationship therebetween to transport said signatures to said customizing means and said primary feeding means.

10. The customizing system of claim 6, wherein the speed of said conveying means is substantially equal to the speed of said first transport means.

11. The customizing system of claim 7, wherein said second transport means comprises upper delivery belts and lower delivery belts, said upper delivery belts and lower delivery belts cooperating to accept signatures from said auxiliary feeding means in sandwiching relationship therebetween and transport said signatures such that each said leading edge is accelerated against said movable lugs on said conveying means.

12. The customizing system of claim 11, wherein said upper delivery belts are adjustable with respect to said conveying means.

13. The customizing system of claim 2, wherein said collating and binding line includes a drive and said primary feeding means, said auxiliary feeding means, said conveying means, and said registration means are commonly driven by said collating and binding line drive.

14. The customizing system of claim 2, wherein said customizing means comprises a plurality of print heads for customizing said signatures such that the printing lies substantially transverse to said leading edges of said signatures.

15. A method for the collating, binding and customizing of signatures in accordance with a predetermined orientation, each of said signatures having a head portion, a foot portion, a leading edge, a trailing edge, an upper surface and a lower surface, the method comprising the steps of:

delivering said signatures to a collation and binding line in spaced apart relationship with each said leading edge being in a predetermined orientation substantially parallel with respect to said collation and binding line;

aligning said signatures individually and continuously along said head portion, said foot portion and one of said leading or trailing edges before their delivery to said collation and binding line such that each said leading edge remains in predetermined orientation substantially parallel to said collation and binding line; and customizing said signatures before their delivery to said collation and binding line in accordance with a predetermined orientation.

16. The method of claim 15, wherein said step of customizing said signatures includes printing said signatures such that the printing lies substantially transverse to each said leading edge.

17. The method of claim 15, wherein said step of delivering said signatures includes positively engaging said upper surface and said lower surface between said head portion and said foot portion across the surface between said leading edge and said trailing edge of each of said signatures for delivery to a driven conveying means.

18. The method of claim 17, wherein said step of delivering said signatures includes driving said leading edge against lugs on said conveying means.

19. A customizing system for a signature collating and binding line having a plurality of signature feeders spaced along the collating and binding line for serially feeding individual signatures thereto, each of said signatures being preprinted and having a head portion, a foot portion, a trailing edge, and a leading edge, said system comprising:

primary feeding means for delivering signatures upon the collating and binding line;

auxiliary feeding means for supplying signatures to said primary feeding means in a flattened, spaced apart position with their leading edges oriented toward the collating and binding line;

conveying means, disposed generally transverse to said collating and binding line, for carrying signatures between said auxiliary feeding means and said primary feeding means;

printing means, including a plurality of adjustable print heads associated with said conveying means disposed between said primary feeding means and said auxiliary feeding means, for printing signatures with customized information before their delivery to the collating and binding line such that the printing lies substantially transverse to the leading edges of the signatures;

portable mounting means adapted for selective interconnection to said collating and binding line for carrying said primary feeding means, said auxiliary feeding means, said conveying means and said printing means;

control means for regulating said printing means;

registration means mounted for movement on said conveying means and defining a register stop traveling generally parallel to said collating and binding line, said registration means including signature guide means mounted stationary adjacent said auxiliary feeding means on said portable mounting means for aligning the head portion and the foot portion of each of said signatures individually and continuously before their delivery to said collating and binding line, said registration means being engageable with said signatures along head portion and said foot portion and one of said trailing or leading edges such that each of said leading edges remains parallel to said collating and binding line;

delivery belt means, cooperating with said auxiliary feeding means, for delivering the signatures in spaced relation to said conveying means at a first speed such that the leading edges of the signatures are driven against said register stop, said register stop moving at a second speed less than said first speed; and pinch belt means, moving at said second speed and cooperating with said conveying means, for nipping the leading edges of the signatures and transporting the signatures to said printing means and said primary feeding means such that the leading edges are maintained generally parallel to said collating and binding line to ensure printing and delivery to said collating and binding line substantially transverse to the leading edges of the signatures.

* * * * *